US010576487B2

(12) United States Patent
Castex et al.

(10) Patent No.: US 10,576,487 B2
(45) Date of Patent: Mar. 3, 2020

(54) JAR COMPRISING MEANS FOR PRESSURIZING A DISPENSING PUMP

(71) Applicant: CHANEL PARFUMS BEAUTE, Neuilly sur Seine (FR)

(72) Inventors: Nicolas Castex, Colombes (FR); Sylvie Legastelois, Asnieres sur Seine (FR); Olivier Perrin, Chatillon (FR); Marc Lassus, Saverne (FR)

(73) Assignee: CHANEL PARFUMS BEAUTE, Neuilly sur Seine (FR)

( * ) Notice: Subject to any disclaimer, the term of this patent is extended or adjusted under 35 U.S.C. 154(b) by 0 days.

(21) Appl. No.: 16/083,117

(22) PCT Filed: Mar. 6, 2017

(86) PCT No.: PCT/EP2017/055186
§ 371 (c)(1),
(2) Date: Sep. 7, 2018

(87) PCT Pub. No.: WO2017/153334
PCT Pub. Date: Sep. 14, 2017

(65) Prior Publication Data

US 2019/0099771 A1 Apr. 4, 2019

(30) Foreign Application Priority Data

Mar. 11, 2016 (FR) ..... 16 52045

(51) Int. Cl.
*B05B 11/00* (2006.01)
*A45D 40/00* (2006.01)
(Continued)

(52) U.S. Cl.
CPC ..... *B05B 11/3053* (2013.01); *A45D 34/00* (2013.01); *A45D 40/0075* (2013.01);
(Continued)

(58) Field of Classification Search
CPC ..... A45D 34/00; A45D 40/0075; A45D 2040/225; A45D 2200/056;
(Continued)

(56) References Cited

U.S. PATENT DOCUMENTS 3,055,041 A * 9/1962 Schaich ..... A45D 34/041 222/505
3,217,933 A * 11/1965 Watson, Jr. ..... B65D 35/28 222/96
(Continued)

FOREIGN PATENT DOCUMENTS

EP 0 222 605 5/1987
EP 0 340 724 11/1989
(Continued)

OTHER PUBLICATIONS

International Search Report and Written Opinion of the ISA for PCT/EP2017/055186, dated Jun. 6, 2017, 17 pages.

*Primary Examiner* — Paul R Durand
*Assistant Examiner* — Andrew P Bainbridge
(74) *Attorney, Agent, or Firm* — Nixon & Vanderhye P.C.

(57) ABSTRACT

The invention relates to a jar comprising:
- a body having an upper wall,
- a flexible pouch containing a product to be dispensed,
- a deformable chamber delimited by a rigid wall and a flexible diaphragm and in fluidic communication with, for the one part, the flexible pouch and, for the other part, a dispensing orifice that opens out at the upper wall,
- a lid mounted on the upper wall so as to be movable between an open position and a closed position, the movement between these positions consisting of the lid being slid over the upper wall, (Continued)

Figure 1:
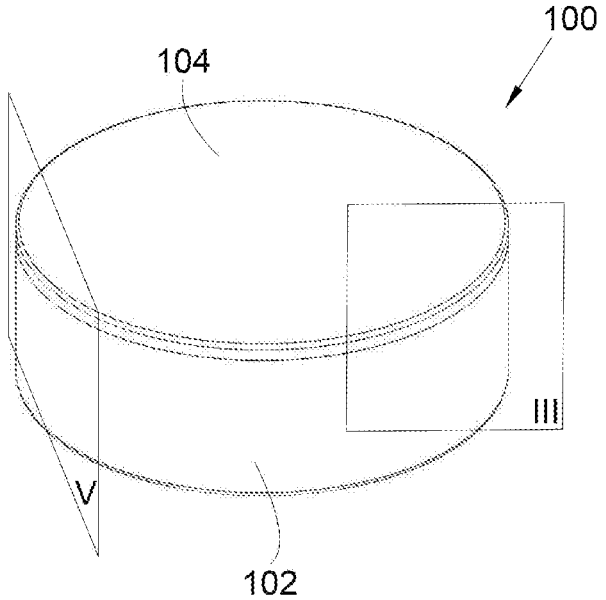

pressurizing means designed to press on the flexible diaphragm while the lid moves from the closed position to the open position.

6 Claims, 5 Drawing Sheets

(51) Int. Cl.
*A45D 34/00* (2006.01)
*A45D 40/22* (2006.01)

(52) U.S. Cl.
CPC ..... *B05B 11/303* (2013.01); *A45D 2040/225* (2013.01); *A45D 2200/056* (2013.01); *B05B 11/007* (2013.01); *B05B 11/0032* (2013.01); *B05B 11/0072* (2013.01); *B05B 11/00412* (2018.08); *B05B 11/3056* (2013.01); *B05B 11/3057* (2013.01)

(58) Field of Classification Search
CPC .. A45D 2200/054; A45D 33/02; A45D 33/04; B05B 11/3053; B05B 11/303; B05B 11/00412; B05B 11/0032; B05B 11/007; B05B 11/0072; B05B 11/3056; B05B 11/3057
USPC ..... 222/206–215, 105–107, 405; 206/581; 132/286–307, 313–318
See application file for complete search history.

(56) References Cited

U.S. PATENT DOCUMENTS 3,926,347 A * 12/1975 Low ..... A47K 5/122 222/181.2
4,463,876 A * 8/1984 Swallert ..... A47K 5/1215 222/105
4,522,317 A * 6/1985 Goncalves ..... A47K 5/1201 222/391
4,776,496 A * 10/1988 Battegazzore ..... B65D 83/0033 222/209
4,778,084 A * 10/1988 Chen ..... B65D 83/0022 222/181.2
4,793,522 A * 12/1988 Corsette ..... B65D 83/0033 222/257
4,830,229 A * 5/1989 Ball ..... A47K 5/1201 222/209
4,903,867 A * 2/1990 Mettenbrink ..... B05B 11/00416 222/207
4,949,875 A * 8/1990 Kuo ..... A46B 11/0006 222/156
4,991,744 A * 2/1991 Von Schuckmann ..... B65D 83/0033 222/136
5,379,919 A * 1/1995 Gueret ..... A45D 34/04 222/108
5,465,873 A * 11/1995 Mejean ..... A45D 40/0075 222/47
5,482,187 A * 1/1996 Poulsen ..... B05B 11/0054 222/207
8,038,034 B2 * 10/2011 Pelfrey ..... A45D 34/04 222/153.13
8,875,953 B2 * 11/2014 Corbin ..... B05B 11/007 222/205
8,887,964 B2 * 11/2014 Jokitalo ..... A47K 5/1208 222/207
9,694,375 B2 * 7/2017 Boulais ..... B05B 11/007
9,914,566 B2 * 3/2018 Chevalier ..... A45D 34/00
2013/0320042 A1 * 12/2013 Santagiuliana ..... B05B 11/3029 222/207
2014/0231461 A1 * 8/2014 Rossignol ..... A45D 33/22 222/183

FOREIGN PATENT DOCUMENTS

FR 2926116 7/2009
WO 2004/073871 9/2004
WO 2009/141510 11/2009

* cited by examiner

PL.3/5

JAR COMPRISING MEANS FOR PRESSURIZING A DISPENSING PUMP

This application is the U.S. national phase of International Application No. PCT/EP2017/055186 filed 6 Mar. 2017, which designated the U.S. and claims priority to FR Patent Application No. 1652045 filed 11 Mar. 2016, the entire contents of each of which are hereby incorporated by reference.

The present invention concerns ajar for a cosmetic or pharmaceutical product of liquid, viscous or solid consistency including means for pressurizing a dispensing pump.

The document FR-A-2 926 116 discloses a jar containing a flexible pouch filled with a product. The jar also includes a deformable chamber that is delimited by a rigid wall, on the one hand, and a flexible diaphragm, on the other hand. The deformable chamber is of globally elongate shape. Via a first end, the deformable chamber is in fluidic communication with the flexible pouch via an opening. Via a second end, the deformable chamber is in fluidic communication with the outside via a slot.

The operating principle consists in, for a user, pressing with their finger on the first end and moving the finger toward the second end in order to cause the product contained in the deformable chamber to exit via the slot. When the user releases their pressure, the slot is closed and the deformable chamber tends to revert to its initial shape. The return to the initial shape is accompanied by aspiration of the product contained in the flexible pouch via the opening.

During this use, the user must exert pressure on the flexible diaphragm which sometimes over time leads to the delivery of a random quantity of product or may prove disagreeable for some users.

An object of the present invention is to propose a jar that does not have the disadvantages of the prior art and in particular avoids the user coming into contact with the flexible diaphragm by installing pressurization means that press on the flexible diaphragm.

To this end, there is proposed a jar including:

- a body having an upper wall,
- a flexible pouch containing a product to be delivered,
- a deformable chamber delimited by a rigid wall and a flexible diaphragm, in fluidic communication with, on the one hand, the flexible pouch and, on the other hand, a dispensing orifice opening onto the upper wall,
- a lid having an exterior upper face visible from the outside and, opposite the exterior upper face, a lower face having substantially the same radius of curvature as the upper wall of the body, mounted on the upper wall to be mobile between an open position and a closed position such that the movement of the lid between the open position and the closed position consists in a sliding of the lid on the upper wall, this one having a flat or concave shape consists in a sliding of the lid on the upper wall,
- pressurization means adapted to press on the flexible diaphragm during the movement of the lid from the closed position to the open position.

According to one particular embodiment, said pressurization means comprise:

- a leaf spring including a central part, at least one first tab fixed to the body on the side of the dispensing orifice, and at least one second tab,
- for each second tab, a shoe attached to the lid and passing through the upper wall, wherein the shape of the leaf spring is such that the central part is flush with the flexible diaphragm when the lid is in the closed position, and wherein the shape of the leaf spring is such that each shoe presses successively on the central part and then on the or each second tab when opening the lid.

According to one particular embodiment, said pressurization means comprise:

- a leaf spring including a common part fixed to the body on the side opposite the dispensing orifice, a central tooth and two lateral teeth on respective opposite sides of the central tooth,
- for each lateral tooth, a shoe attached to the lid and passing through the upper wall, wherein the shape of the leaf spring is such that the central tooth is flush with the flexible diaphragm when the lid is in the closed position, and wherein the shape of the leaf spring is such that each shoe presses on a lateral tooth during opening of the lid.

According to one particular embodiment, said pressurization means comprise:

- a plate disposed above the flexible pouch and that is pierced by a window through which pass the deformable chamber and the dispensing orifice,
- a slide mounted on the plate to be mobile in translation and featuring a central bar mobile along the window, and
- a transmission system that transmits the movement of the lid to the slide by moving the slide from a position far from the dispensing orifice to a position near the dispensing orifice when the lid passes from the closed position to the open position.

The slide advantageously features two ramps, each being fixed to one end of the central bar, and the transmission system includes:

- for each ramp, a first toothed sector extending along said ramp,
- for each first toothed sector, a toothed wheel mounted on the plate to be mobile in rotation and meshing with said toothed sector, and
- for each toothed wheel, a second toothed sector attached to the lid, passing through the upper wall and meshing with said toothed wheel diametrally opposite the first toothed sector.

According to one particular embodiment, said pressurization means comprise:

- a plate disposed above the flexible pouch and pierced by a window through which pass the deformable chamber and the dispensing orifice,
- at least one cam with a protruding zone, which is mounted on the plate to be free to rotate and attached to a toothed wheel coaxial with the axis of the cam,
- for each cam, a toothed sector attached to the lid, passing through the upper wall and meshing with the tooled wheel of said cam, in such a manner as to transmit the movement of the lid to the cam by moving the protruding zone from a position in which it does not press on the flexible diaphragm to a position in which it presses on the flexible diaphragm when the lid passes from the closed position to the open position.

Figure 2:
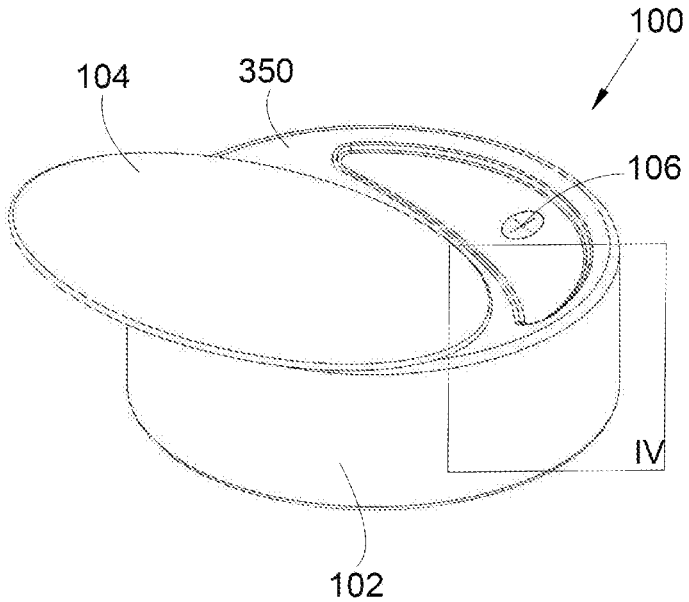
Figure 3:
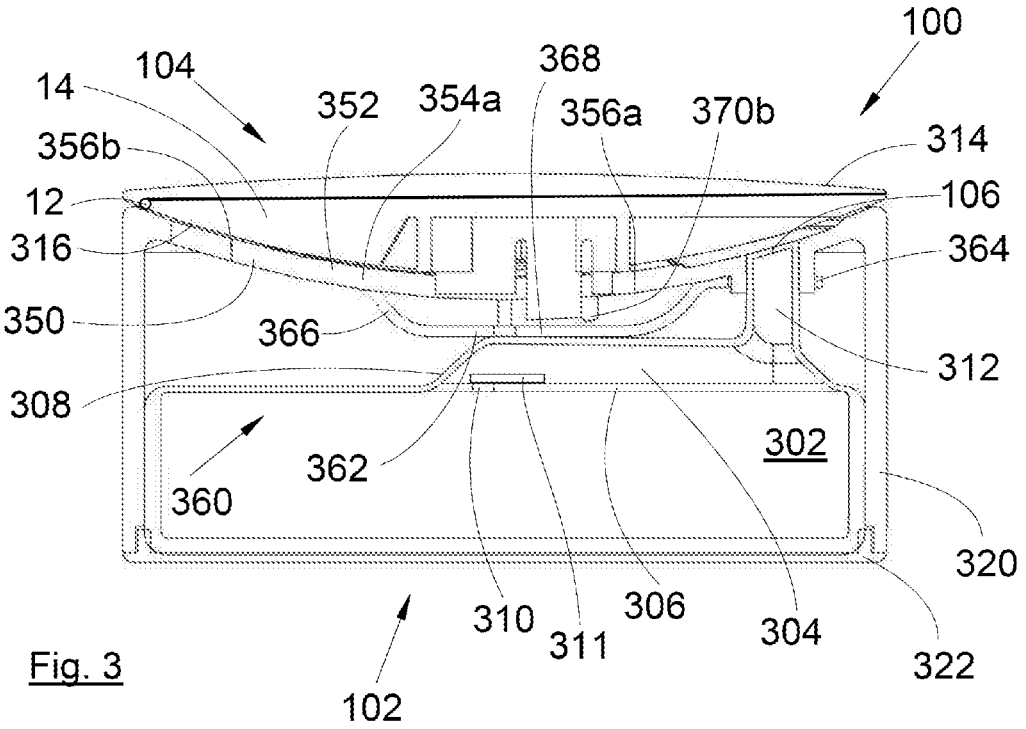
Figure 4:
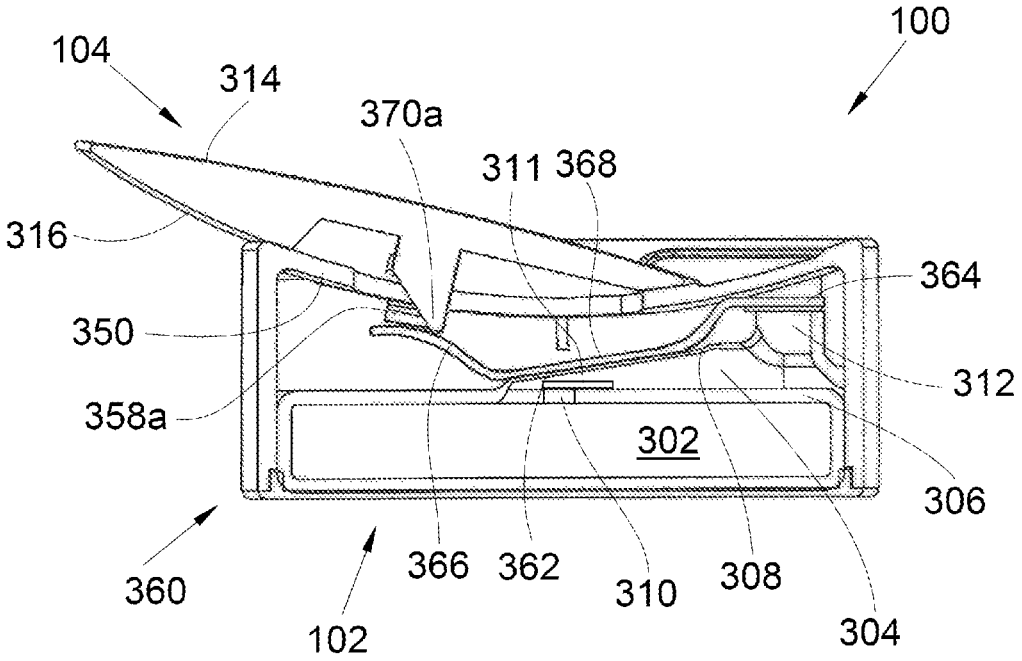
Figure 5:
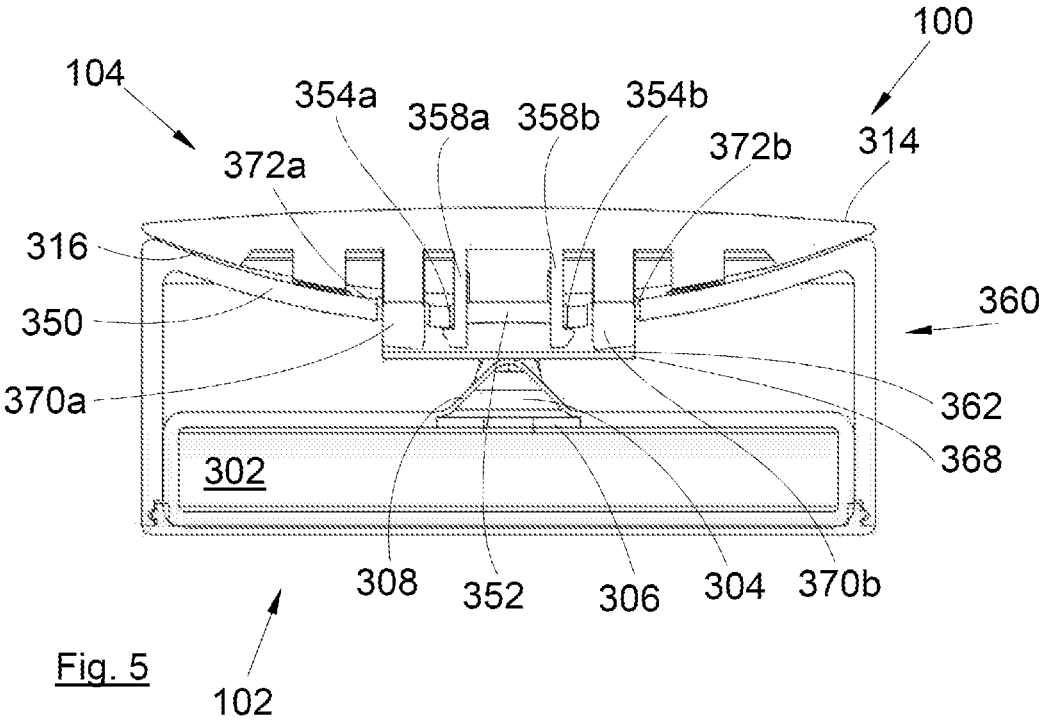
Figure 6:
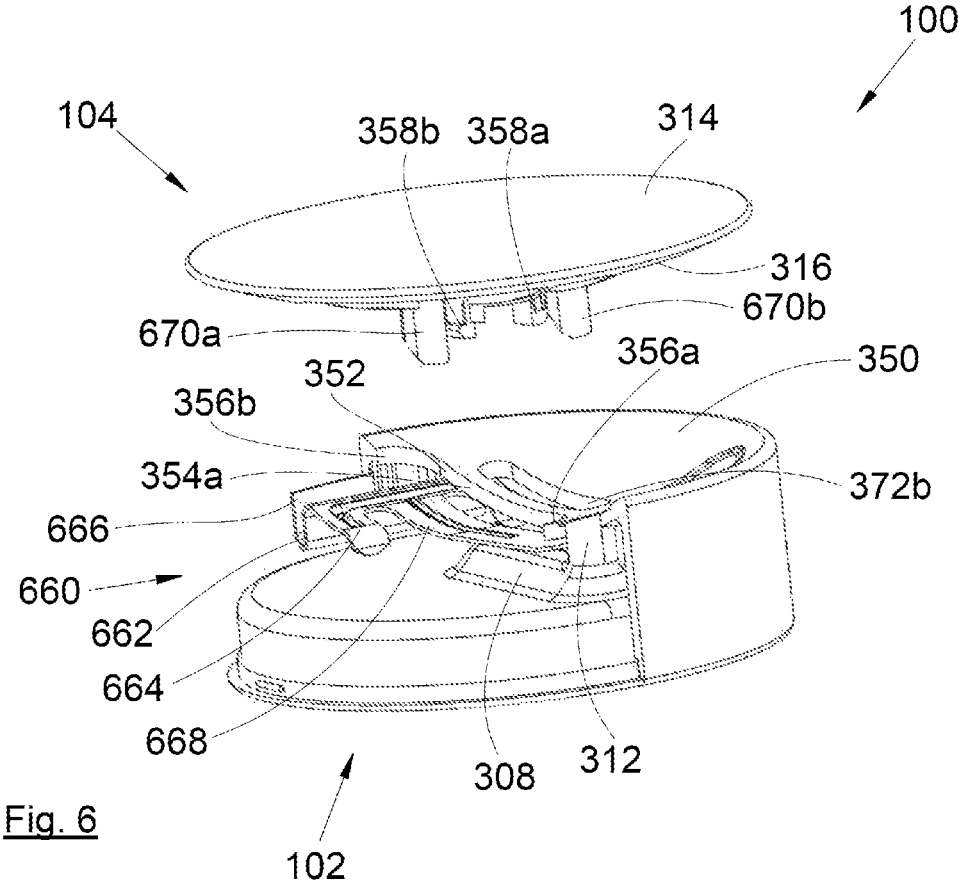
Figure 7:
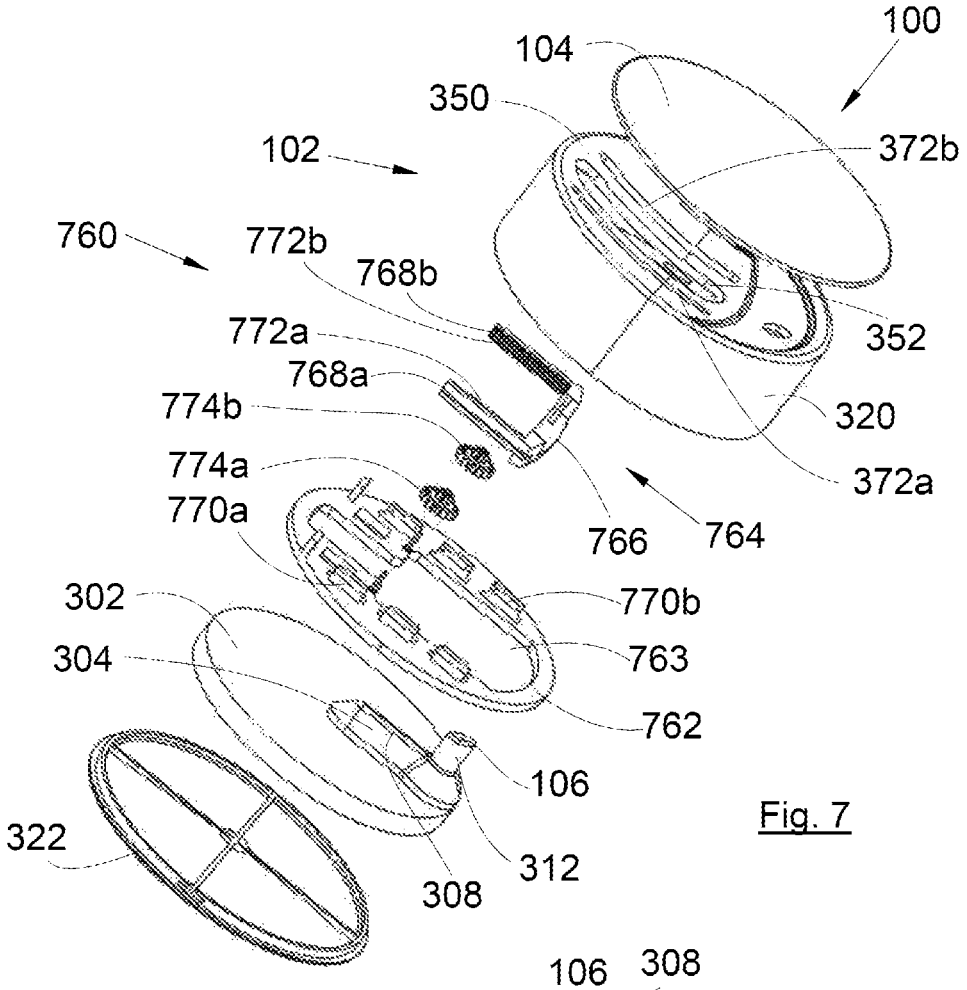
Figure 8:
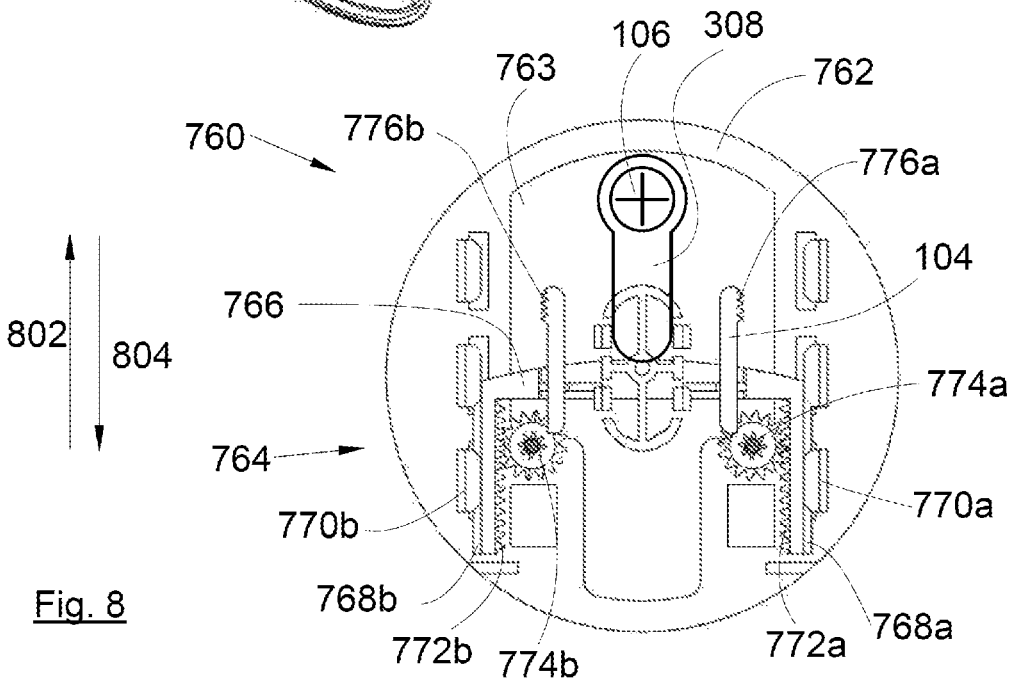
Figure 9:
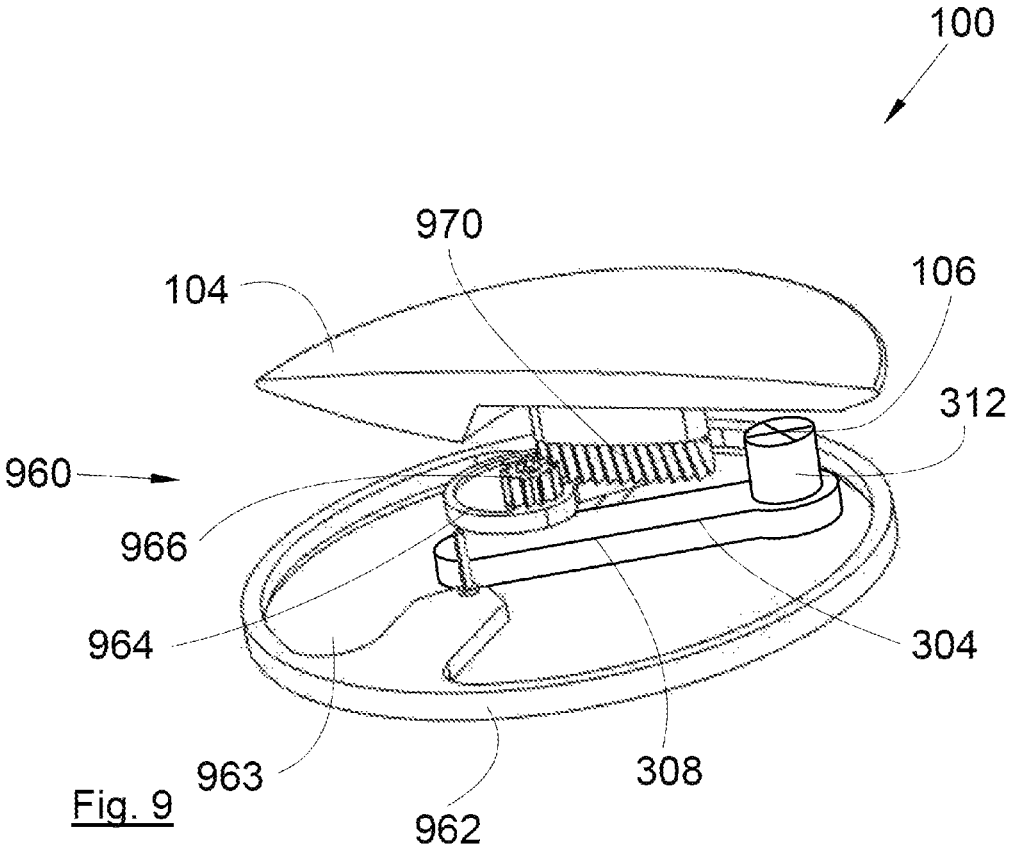
Figure 10:
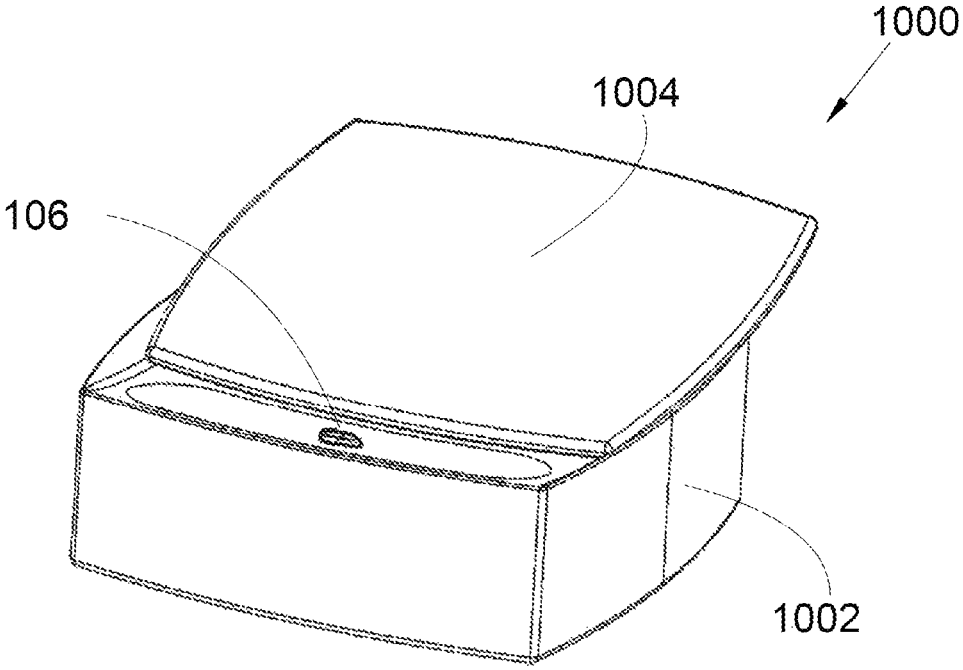

The features of the invention mentioned hereinabove, together with others, will become more clearly apparent on reading the following description of one embodiment, said description being given with reference to the appended drawings, in which:

FIG. 1 shows a perspective view of a jar according to the invention in which a lid is in a closed position, FIG. 2 shows a perspective view of the jar from FIG. 1 with the lid in an open position, FIG. 3 shows a sectional view of the jar from FIG. 1 on the plane III according to a first embodiment of the invention, FIG. 4 shows a sectional view of the jar from FIG. 2 on the plane IV, FIG. 5 shows a sectional view of the jar from FIG. 1 on the plane V, FIG. 6 shows a part-sectional view of a jar according to a second embodiment of the invention, FIG. 7 shows an exploded view of a jar according to a third embodiment of the invention, FIG. 8 shows a top view of the pressurization means from FIG. 7, FIG. 9 shows a part-sectional view of a jar according to a fourth embodiment of the invention, and FIG. 10 shows a perspective view of a jar with a different shape.

In the following description, terms relating to a position are used with reference to ajar placed on a support, that is to say as shown in FIG. 3.

FIG. 1 shows a jar 100 that includes a body 102 and a lid 104 that is in a closed position. Here the jar 100 is of cylindrical shape, but its shape and its volume 100 may be different. In the same manner, here the lid 104 has the shape of a disk, but it may have a different shape.

For example, FIG. 10 shows a jar 1000 that includes a body 1002 and a lid 1004. In this embodiment of the invention, the body 1002 and the lid 1004 have a rectangular shape. In the following description, the invention is more particularly described in the case of the jar 100 from FIG. 1, but it applies in the same manner to the jar 1000 from FIG. 10.

FIG. 2 shows the jar 100 when the lid 104 is an open position, uncovering an upper wall 350 of the body 102, which uncovers a dispensing orifice 106 through which flows a product contained in a flexible pouch (302, FIG. 3) of the body 102. The product may be of different types such as for example a cosmetic or pharmaceutical product of viscous, paste-like or solid consistency (e.g. cream, foundation, face powder, etc.). The dispensing orifice 106 therefore opens onto the upper wall 350, that is to say through the upper wall 350.

In the case of FIG. 1, the jar 100 also has a lateral wall 320 which here is cylindrical and extends from the upper wall 350, and a bottom 322 that closes the lateral wall 320 and encloses the flexible pouch 302.

In the case of FIG. 10, the lateral wall has a rectangular base.

The dispensing orifice 106 takes the form of a one-way valve that allows the passage of a fluid from the interior to the exterior, but prevents the passage of a fluid in the opposite direction. It may, for example, be a flexible film featuring a straight or cruciform slot. Any other shape of film may be equally suitable, of course.

FIG. 3 shows the jar 100 in section. The body 102 contains the fluid-tight flexible pouch 302 containing the product to be dispensed. A deformable chamber 304 is delimited by a rigid wall 306 and a flexible diaphragm 308. The rigid wall 306 is disposed above the flexible pouch 302 and the flexible diaphragm 308 is disposed above the rigid wall 306.

The rigid wall 306 is pierced by an opening 310 that provides the fluidic communication between the flexible pouch 302 and the deformable chamber 304. The deformable chamber 304 is also in fluidic communication with the dispensing orifice 106, here via a chimney 312. The opening 310 is blocked by a check valve 311 that allows the passage of the fluid from the flexible pouch 302 to the deformable chamber 304, but prevents the passage of a fluid in the opposite direction. The check valve 311 is therefore active when the deformable chamber 304 is pressurized relative to the flexible pouch 302, thereby preventing the product to be dispensed from returning into the flexible pouch 302 because of the pressure on the flexible diaphragm 308. Here the check valve 311 takes the form of a tongue fixed to the interior of the deformable chamber 304 and which is pressed against the opening 310. It is well understood that any other form of closure member may be equally suitable.

The deformable chamber 304 has a globally elongate shape featuring at a first end the chimney 312 and at a second end the opening 310.

The lid 104 is mounted on the upper wall 350 to be mobile between the open position and the closed position in which the lid 104 comes over the dispensing orifice 106. The lid 104 includes first retaining means and the body 102 includes second retaining means that cooperate with the first retaining means to retain the body 102 and the lid 104 attached together whilst allowing the sliding of the lid 104 on the upper wall 350 of the body 102.

FIG. 4 shows the jar 100 with the lid in the open position and FIG. 5 shows a section of the jar 100 showing in particular the retaining means.

In the embodiment of the invention shown in FIGS. 1 to 9, the upper wall 350 is of part-spherical concave shape. In the upper wall 350 is formed a main slot 352 having lateral edges 354*a-b* parallel to the direction of movement of the lid 104 between its open position and its closed position. The mains lot 352 also has front edges 356*a-b*, which are globally perpendicular to the lateral edges 354*a-b*.

The lid 104 features an exterior upper face 314 visible from the outside and, opposite the exterior upper face 314, a lower face 316 that is of part-spherical convex shape having substantially the same radius of curvature as the upper wall 350 of the body 102. The lower face 316 and the upper wall 350 are intended to slide one on the other during the movement of the lid 104 from the open position to the closed position and vice-versa.

In the embodiment of the invention shown in FIG. 10, the upper wall is of part-cylindrical concave shape and the lower face of the lid is of part-cylindrical convex shape having substantially the same radius of curvature as the upper wall of the body.

In the embodiment of the invention shown in FIGS. 1 to 10, the movement of the lid 104, 1004 is therefore globally a rotation, but it is possible to envisage that the movement be a movement in translation, if the lower face 316 and the upper wall 350 are flat.

Here the first retaining means take the form of two clips 358*a-b*, each having a wall that comes into contact with one of the lateral edges 354*a-b* to provide longitudinal guidance and a hook at the end of the wall that lodges under the upper wall 350 via the main slot 352 to fasten together the body 102 and the lid 104. Here the lateral edges 354*a-b* form the second retaining means.

The jar 100 equally includes pressurization means that are adapted to press on the flexible diaphragm 308 during the movement of the lid 104 from the closed position to the open position. Thus, on opening the lid 104, the product contained in the deformable chamber 304 is expelled via the dispensing orifice 106. Thus, the user does not come into contact with the flexible diaphragm 308 and the complete movement of the lid 104 enables a calibrated quantity of product to be delivered, that quantity substantially corresponding to the volume of the deformable chamber 304.

After the return of the lid to the closed position, the pressurization means no longer exert any pressure on the flexible diaphragm 308 which is reinflated by virtue of its elasticity and aspirates the product contained in the flexible pouch 302. To ensure this return of the flexible diaphragm 308 to the initial position, the latter is constituted of an elastic material that tends to revert to its initial shape such as for example a film of TPE, TPU or silicone. The flexibility of the flexible pouch 302 allows aspiration of the product into the deformable chamber 304 without there being any ingress of air. The flexible pouch 302 is made from an elastic material such as for example PE, PP, Surlyn®, aluminum or a multilayer complex.

FIGS. 3 to 5 show pressurization means 360 according to a first embodiment, FIG. 6 shows pressurization means 660 according to a second embodiment, FIGS. 7 and 8 show pressurization means 760 according to a third embodiment and FIG. 9 shows pressurization means 960 according to a fourth embodiment.

According to the first embodiment, the pressurization means 360 comprise a leaf spring 362 extending substantially horizontally and featuring a central part 368, two first tabs 364 fixed by their bases to the central part 368 and fixed to the body 102 by their free ends, more particularly underneath the upper wall 350 on the same side as and on respective opposite sides of the dispensing orifice 106, two second tabs 366 fixed by their bases to the central part 368 and the free ends of which are not fixed. The two first tabs 364 extend from one side of the central part 368 relative to the direction of movement of the lid 104, and the two second tabs 366 extend from the other side of the central part 368, globally forming an H when seen from above.

The shape of the leaf spring 362 is such that the central part 368 becomes flush with the upper part of the flexible diaphragm 308 when the lid 104 is in the closed position.

In the embodiment of the invention shown here, the central part 368 is flat and the two first tabs 364 and the two second tabs 366 are raised relative to the central part 368.

The pressurization means 360 equally comprise two shoes 370*a-b* attached to the lid 104 and passing through the upper wall 350 via two secondary slots 372*a-b* in the upper wall 350 disposed on respective opposite sides of the main slot 352. Each shoe 370*a-b* is designed to come to press on the central part 368 in the closed position of the lid 104 (FIG. 3) and to press successively on the central part 368 and on the two second tabs 366 during opening of the lid 104 (FIG. 4).

Because of the circular movement of the lid 104 during opening thereof and the shape of the central part 368 and the two second tabs 366, the central part 368 descends and presses on the flexible diaphragm 308 thus tending to expel the product contained in the deformable chamber 304 via the dispensing orifice 106.

The shapes of the leaf spring 362 and of the shoes 370*a-b* may be different, depending on the movement of the lid 104 and the quantity of product to be expelled.

In the same manner, in the embodiment of the invention shown here, there are two shoes 370*a-b*, but it is possible to provide only one central one passing through the main slot 352 to press on the central part 368 and only one second tab 366.

Finally, it is equally possible to provide only one first tab 364 fixed in a central manner, depending on the space available.

Thus, generally speaking, for the pressurization means 360 according to the first embodiment, said pressurization means 360 comprise:

- a leaf spring 362 itself including a central part 368, at least one first tab 364 fixed to the body 102 on the same side as the dispensing orifice 106, and at least one second tab 366 on the side opposite the dispensing orifice 106,
- for each second tab 366, a shoe 370*a-b* attached to the lid 104 and passing through the upper wall 350, wherein the shape of the leaf spring 362 is such that the central part 368 is flush with the flexible diaphragm 308 when the lid 104 is in the closed position, and wherein the shape of the leaf spring 362 is such that each shoe 370*a-b* presses successively on the central part 368 and then on the or each second tab 366 when opening the lid 104.

During the closing of the lid 104, the leaf spring 362 tends to rise to resume its initial position not pressing on the flexible diaphragm 308.

According to the second embodiment, the pressurization means 660 comprise a leaf spring 662 taking the form of a trident with a central tooth 668 and two lateral teeth 664 (only one of which is seen) on respective opposite sides of the central tooth 668. The base of each tooth 664, 668 is fixed to a common part 666 itself fixed to the body 102, more particularly underneath the upper wall 350 on the side opposite the dispensing orifice 106. Each tooth 664, 668 extends substantially horizontally from the common part 664 in the direction of the dispensing orifice 106.

The shape of the leaf spring 662 is such that the central tooth 668 comes to be flush with the upper part of the flexible diaphragm 308 when the lid 104 is in the closed position.

The pressurization means 660 equally comprise two shoes 670*a-b* attached to the lid 104 and passing through the upper wall 350 through two secondary slots 372*a-b* in the upper wall 350 disposed on respective opposite sides of the main slot 352. Each shoe 670*a-b* is designed to come to press on a lateral tooth 664 and to press increasingly on that lateral tooth 664 during the opening of the lid 104.

Because of the movement of the lid 104 during its opening and the shape of each lateral tooth 664, each lateral tooth 664 descends and equally obliges the central tooth 668 to descend. The central tooth 668 then presses on the flexible diaphragm 308 thus tending to expel the product contained in the deformable chamber 304 via the dispensing orifice 106.

The shapes of the leaf spring 662 and of the shoes 670*a-b* may be different, depending on the movement of the lid 104 and on the quantity of product to be expelled.

During the closing of the lid 104, the leaf spring 662 tends to rise to resume its initial position not pressing on the flexible diaphragm 308.

FIG. 7 shows an exploded view and FIG. 8 a top view without the body 102 and without part of the lid 104 in order to show the pressurization means 760 according to the third embodiment.

The pressurization means 760 include a plate 762 which may be in one piece with the body 102 or an independent part fixed to the interior of the body 102 above the flexible pouch 302. The plate 762 features a window 763 through which pass the deformable chamber 304, the chimney 312 and the dispensing orifice 106.

The pressurization means 760 equally include a slide 764 mounted on the plate 762 to be mobile in translation. The slide 764 features a central bar 766 that is positioned in the window 763, and two ramps 768*a-b*, each being fixed to one end of the central bar 766. Each ramp 768*a-b* is guided in translation by the plate 762 which to this end includes grooves 770*a-b* here of U shape. Thus the central bar 766 is mobile along the window 763 and presses on the flexible diaphragm 308 when moving from a position far from the dispensing orifice 106 to a position near the dispensing orifice 106 (as represented by the arrow 802 in FIG. 8).

The pressurization means 760 equally include a transmission system that transmits the movement of the lid 104 to the slide 764 by moving the slide 764 from a position far from the dispensing orifice 106 to a position near the dispensing orifice 106 when the lid 104 passes from the closed position to the open position, and vice-versa.

In the embodiment of the invention shown in FIGS. 7 and 8, the transmission system includes:

for each ramp 768*a-b*, a first toothed sector 772*a-b* extending along said ramp 768*a-b*, for each first toothed sector 772*a-b*, a toothed wheel 774*a-b* meshing with said toothed sector 772*a-b*, said toothed wheel 774*a-b* being mounted on the plate 762 to be mobile in rotation about an axis perpendicular to the plane in which the slide 764 moves, and for each toothed wheel 774*a-b*, a second toothed sector 776*a-b* that is attached to the lid 104, that passes through the upper wall 350 via a secondary slot 372*a-b* and that meshes with said toothed wheel 774*a-b* diametrally opposite the first toothed sector 772*a-b*.

Thus, the movement of the lid 104 from the closed position to the open position (in the direction of the arrow 804) leads to the movement of the second toothed sectors 776*a-b* in the same direction (804), then by meshing, the toothed wheels 774*a-b*, and finally the first toothed sectors 772*a-b* in the direction 802. The movement is reversed when the lid 104 is moved from the open position to the closed position.

The two secondary slots 372*a-b* are disposed on respective opposite sides of the main slot 352.

In order to ensure that the product is expelled only when the dispensing orifice 106 is uncovered, the second toothed sectors 776*a-b* mesh with the toothed wheels 774*a-b* only after the lid 104 has uncovered said dispensing orifice 106, which is why in the closed position (FIG. 7) the second toothed sectors 776*a-b* have a limited extent and mesh only at the end of the travel of the lid 104.

To ensure rapid expulsion of the product, each toothed wheel 776*a-b* is twinned in order to provide demultiplication.

FIG. 9 shows a part of ajar 100 with pressurization means 960 according to the fourth embodiment.

The pressurization means 960 include a plate 962 which may be a part in one piece with the body 102 or an independent part fixed to the interior of the body 102 above the flexible pouch 302. The plate 962 features a window 963 through which pass the deformable chamber 304, the chimney 312 and the dispensing orifice 106.

The pressurization means 960 equally include at least one cam 964 mounted on the plate 962 to rotate freely about an axis that here is vertical, and attached to a toothed wheel 966 coaxial with the axis of the cam 964. The cam 964 features a protruding zone.

The position and the shape of the or each cam 964 are such that in the closed position of the lid 104 the protruding zone does not press on the flexible diaphragm 308 and in the open position of the lid 104 the protruding zone presses on the flexible diaphragm 308 after rotation of the cam 964.

In a preferred embodiment, there are two cams 964 symmetrically disposed on respective opposite sides of the longitudinal axis of symmetry of the deformable chamber 304. In FIG. 9, only one cam 964 has been represented for clarity.

The pressurization means 960 equally include a transmission system that transmits the movement of the lid 104 to each cam 964 by causing each cam 964 to pivot in such a manner that the protruding zone passes from a position in which it does not press on the flexible diaphragm 308 to a position in which it presses on the flexible diaphragm 308 when the lid 104 passes from the closed position to the open position.

In the embodiment of the invention shown, the transmission system includes for each cam 964 a toothed sector 970 attached to the lid 104 that passes through the upper wall 350 via an appropriate slot and that meshes with the toothed wheel 966 of said cam 964.

Thus, the movement of the lid 104 from the closed position to the open position leads to the movement of the toothed sectors 970 and then by meshing the toothed wheels 966 and finally the cams 964. The movement is reversed when the lid 104 is moved from the open position to the closed position.

As shown in the embodiment from FIG. 3, although this can apply to all the other embodiments, the exterior upper face 314 of the lid 104 is rotatably mounted on a hinge 12 that is situated opposite the dispensing orifice 106. This arrangement forms a check valve that enables a mirror to be housed inside the lid on the face opposite the exterior upper face 314, and/or a sponge to be housed in the lower part 14 of the lid 104.

The invention claimed is:

1. A jar including:

a body having an upper wall, a flexible pouch containing a product to be delivered, a deformable chamber delimited by a rigid wall and a flexible diaphragm, in fluidic communication with the flexible pouch and a dispensing orifice opening onto the upper wall, a lid having an exterior upper face visible from the outside and, opposite the exterior upper face, a lower face having substantially the same radius of curvature as the upper wall of the body, mounted on the upper wall to be mobile between an open position and a closed position such that the movement of the lid between the open position and the closed position consists in a sliding of the lid on the upper wall, this one having a flat or concave shape, pressurization means adapted to press on the flexible diaphragm during the movement of the lid from the closed position to the open position.

2. The jar as claimed in claim 1, wherein said pressurization means comprise:

a leaf spring including a central part, at least one first tab fixed to the body on the same side as the dispensing orifice, and at least one second tab, for each second tab, a shoe attached to the lid and passing through the upper wall, wherein the shape of the leaf spring is such that the central part is flush with the flexible diaphragm when the lid is in the closed position, and wherein the shape of the leaf spring is such that each shoe presses successively on the central part and then on the or each second tab when opening the lid.

3. The jar as claimed in claim 1, wherein said pressurization means comprise:

a leaf spring including a common part fixed to the body on the side opposite the dispensing orifice, a central tooth and two lateral teeth on respective opposite sides of the central tooth, for each lateral tooth, a shoe attached to the lid and passing through the upper wall, wherein the shape of the leaf spring is such that the central tooth is flush with the flexible diaphragm when the lid is in the closed position, and wherein the shape of the leaf spring is such that each shoe presses on a lateral tooth during opening of the lid.

4. The jar as claimed in claim 1, wherein said pressurization means comprise:

a plate disposed above the flexible pouch and that is pierced by a window through which pass the deformable chamber and the dispensing orifice, a slide mounted on the plate to be mobile in translation and featuring a central bar mobile along the window, and a transmission system that transmits the movement of the lid to the slide by moving the slide from a position far from the dispensing orifice to a position near the dispensing orifice when the lid passes from the closed position to the open position.

5. A jar as claimed in claim 4, wherein the slide features two ramps, each being fixed to one end of the central bar, and wherein the transmission system includes:

for each ramp, a first toothed sector extending along said ramp, for each first toothed sector, a toothed wheel mounted on the plate to be mobile in rotation and meshing with said toothed sector, and for each toothed wheel, a second toothed sector attached to the lid, passing through the upper wall and meshing with said toothed wheel diametrally opposite the first toothed sector.

6. The jar as claimed in claim 1, wherein said pressurization means comprise:

a plate disposed above the flexible pouch and pierced by a window through which pass the deformable chamber and the dispensing orifice, at least one cam with a protruding zone, which is mounted on the plate to be free to rotate and attached to a toothed wheel coaxial with the axis of the cam, for each cam, a toothed sector attached to the lid, passing through the upper wall and meshing with the toothed wheel of said cam, in such a manner as to transmit the movement of the lid to the cam by moving the protruding zone from a position in which the protruding zone does not press on the flexible diaphragm to a position in which the protruding zone presses on the flexible diaphragm when the lid passes from the closed position to the open position.

* * * * *